US010466642B2

(12) United States Patent
Amemiya et al.

(10) Patent No.: US 10,466,642 B2
(45) Date of Patent: Nov. 5, 2019

(54) SOLID LUBRICANT, SOLID LUBRICANT COATER AND IMAGE FORMING APPARATUS

(71) Applicant: Konica Minolta, Inc., Tokyo (JP)

(72) Inventors: Taiki Amemiya, Tokyo (JP); Yukio Hosoya, Tokyo (JP); Kunihiro Ogura, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/183,086

(22) Filed: Nov. 7, 2018

(65) Prior Publication Data

US 2019/0163115 A1 May 30, 2019

(30) Foreign Application Priority Data

Nov. 27, 2017 (JP) ..... 2017-227003

(51) Int. Cl.

| | |
|---|---|
| ***G03G 21/00*** | (2006.01) |
| ***C10M 111/04*** | (2006.01) |
| ***C10M 169/04*** | (2006.01) |
| ***G03G 5/00*** | (2006.01) |
| *C10N 50/08* | (2006.01) |

(52) U.S. Cl.

CPC ..... *G03G 21/0094* (2013.01); *C10M 111/04* (2013.01); *C10M 169/044* (2013.01); *G03G 5/005* (2013.01); *C10M 2201/105* (2013.01); *C10M 2207/10* (2013.01); *C10M 2207/103* (2013.01); *C10M 2209/084* (2013.01); *C10M 2213/0606* (2013.01); *C10M 2229/051* (2013.01); *C10N 2050/08* (2013.01); *C10N 2220/082* (2013.01); *C10N 2230/06* (2013.01); *C10N 2240/20* (2013.01); *G03G 21/0005* (2013.01)

(58) Field of Classification Search

None

See application file for complete search history.

(56) References Cited

U.S. PATENT DOCUMENTS

2012/0021345 A1* 1/2012 Nukada ..... G03G 5/0614 430/56
2014/0321882 A1* 10/2014 Iwadate ..... G03G 5/0517 399/111

FOREIGN PATENT DOCUMENTS

JP 2006-058748 A 3/2006
JP 2011-059315 A 3/2011

* cited by examiner

*Primary Examiner* — Sevan A Aydin
(74) *Attorney, Agent, or Firm* — Lucas & Mercanti, LLP

(57) ABSTRACT

The present invention relates to a solid lubricant to be coated on an image bearing member included in an electrophotographic image forming apparatus. The solid lubricant contains a resin particle and metal soap. The resin particle includes a particle body containing an amorphous resin as a principal component, and a fluorine atom supported on a surface of the particle body. The resin particle is a particle having a volume average particle size of 70 nm or more. The solid lubricant can sufficiently increase a cleaning effect in the image forming apparatus.

10 Claims, 3 Drawing Sheets

SOLID LUBRICANT, SOLID LUBRICANT COATER AND IMAGE FORMING APPARATUS

CROSS REFERENCE TO RELATED APPLICATIONS

Japanese Patent Application No. 2017-227003 filed on Nov. 27, 2017, including description, claims, drawings, and abstract the entire disclosure is incorporated herein by reference in its entirety.

BACKGROUND

Technological Field

The present invention relates to a solid lubricant, a solid lubricant coater and an image forming apparatus.

Description of Related Art

As an electrophotographic image forming apparatus such as a printer, an image forming apparatus including an image bearing member (hereinafter, sometimes referred to as the "photoconductor") corresponding to a transfer medium that transfers, to an intermediate transfer member, a toner image formed by applying a toner to an electrostatic latent image; a cleaning device that removes an untransferred toner not transferred to a substrate from a surface of the photoconductor by bringing an elastic member (hereinafter sometimes referred to as the "cleaning member") into contact with the surface; and a solid lubricant coater that coats a solid lubricant on the surface of the photoconductor is known. As the solid lubricant coater, one including a coating member for coating a solid lubricant on the surface and an abutment member for bringing the solid lubricant into contact with the coating member by pressing is known as described in Japanese Patent Application Laid-Open No. 2006-058748.

The solid lubricant is cut with a rotary brush or the like included in the solid lubricant coater, and then coated on the surface of the photoconductor. The thus cut and coated powder of the solid lubricant increases releasability of the untransferred toner from the surface of the photoconductor, and makes the untransferred toner easily removed by a cleaning blade or the like included in the cleaning device.

Japanese Patent Application Laid-Open No. 2006-058748 describes a solid lubricant containing an inorganic fine particle or an organic fine particle having an average particle size of 50 to 500 nm. According to Japanese Patent Application Laid-Open No. 2006-058748, the inorganic fine particle or the organic fine particle deposits on an edge portion of a cleaning blade to block the untransferred toner and prevents the untransferred toner from slipping through the cleaning blade, and thus, efficiency of removing the untransferred toner is further improved.

It is known that metal soap (fatty acid metal salt) can be used as a material of a solid lubricant. Besides, for example, Japanese Patent Application Laid-Open No. 2011-059315 states that a fatty acid metal salt and a fluorine-based resin can be used as a material of a solid lubricant. It is noted that a fluorine-based resin is known to have low surface energy.

SUMMARY

In an image forming apparatus using a solid lubricant containing an inorganic fine particle or an organic fine particle as described in Japanese Patent Application Laid-Open No. 2006-058748, however, improvement of a cleaning property owing to a blocking effect derived from such a particle cannot be obtained as expected.

Incidentally, according to knowledge of the present inventors, even when the fluorine-based resin described in Japanese Patent Application Laid-Open No. 2011-059315 is formed into a fine particle to be contained in a solid lubricant as described in Japanese Patent Application Laid-Open No. 2006-058748, the improvement of the cleaning property owing to the blocking effect derived from the fine particle also cannot be obtained as expected.

In consideration of these circumstances, an object of the present invention is to provide a solid lubricant capable of sufficiently improving a cleaning effect in an image forming apparatus using a solid lubricant containing a fine particle, and a solid lubricant coater and an image forming apparatus using the solid lubricant.

In view of the above object, the present invention provides a solid lubricant to be coated on an image bearing member included in an electrophotographic image forming apparatus, including: a resin particle and metal soap, in which the resin particle includes a particle body containing an amorphous resin as a principal component, and a fluorine atom supported on a surface of the particle body, and the resin particle is a particle having a volume average particle size of 70 nm or more.

In view of the above object, the present invention provides a solid lubricant coater for coating a solid lubricant on a surface of an image bearing member included in an electrophotographic image forming apparatus, including: a coating member that coats the solid lubricant according to claim 1 on the surface of the image bearing member; and an abutment member that brings the solid lubricant into contact with the coating member by pressing.

In view of the above object, the present invention provides an electrophotographic image forming apparatus, including: an image bearing member; a cleaner that removes an untransferred toner from a surface of the image bearing member by bringing an elastic member into contact with the surface; and the solid lubricant coater according to claim 7 that coats the solid lubricant on the surface of the image bearing member.

According to the present invention, a solid lubricant capable of sufficiently improving a cleaning effect in an image forming apparatus using a solid lubricant containing a fine particle, and a solid lubricant coater and an image forming apparatus using the solid lubricant are provided.

BRIEF DESCRIPTION OF DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

1. Solid Lubricant

One embodiment of the present invention relates to a solid lubricant containing a resin particle and metal soap.

1-1. Resin Particle

The resin particle includes a particle body containing an amorphous resin as a principal component, and a fluorine atom supported on a surface of the particle body.

A metal soap (fatty acid metal salt) used in a solid lubricant is easily cleaved into a flaky cut powder. Besides, the metal soap in the shape of a flaky cut powder easily adsorbs an organic fine particle. Therefore, even when a solid lubricant containing an organic fine particle described in Japanese Patent Laid-Open No. 2006-058748 is used, the fine particle is adsorbed by the metal soap in the shape of a flaky cut powder and hence is restricted from freely moving, and therefore, a blocking layer capable of sufficiently blocking an untransferred toner is presumed to be difficult to form.

Figure 1:
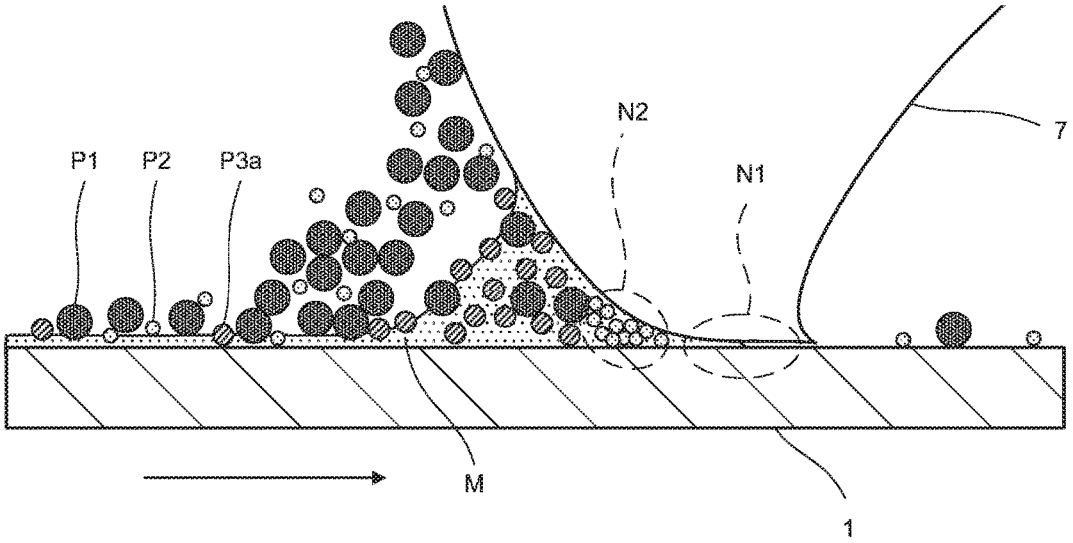
FIG. 1 is a schematic diagram enlargedly illustrating a state in the vicinity of a contact portion between a cleaning blade included in a cleaning device and a surface of a photoconductor when a solid lubricant containing an organic fine particle is used.

FIG. 1 is a schematic diagram enlargedly illustrating a state in the vicinity of a contact portion between a cleaning blade included in a cleaning device and a surface of a photoconductor when a solid lubricant containing an organic fine particle is used.

Cleaning blade 7 is one obtained by processing, into a sheet shape, an elastic material such as polyurethane rubber, and is disposed to come into contact with an axial direction of photoconductor 1 in parallel to a peripheral surface of photoconductor 1. During the rotation of photoconductor 1, a frictional force is generated between photoconductor 1 and cleaning blade 7, and this frictional force elastically deforms cleaning blade 7, so as to form, in a tip end thereof, cleaning nip section N1 where cleaning blade 7 and the surface of photoconductor 1 are in contact with each other. Besides, on an upstream side from cleaning nip section N1 in a rotational direction (illustrated with an arrow in the drawing) of photoconductor 1, a space (collection section N2) is formed between a surface of cleaning blade 7 and the surface of photoconductor 1 gradually approaching the surface of cleaning blade 7.

When photoconductor 1 rotates, cleaning blade 7 scrapes toner particle P1 of an untransferred toner adhering to the peripheral surface of photoconductor 1 off from the peripheral surface of photoconductor 1. On the other hand, external additive P2 of the untransferred toner is smaller than toner particle P1 and hence easily reaches collection section N2, and therefore, a blocking layer (external additive collection) mainly of external additive P2 is easily formed in collection section N2.

The blocking layer attenuates energy of toner particle P1 rushing into cleaning nip section N1, and makes toner particle P1 difficult to pass through a gap in cleaning nip section N1.

On the other hand, organic fine particle P3*a* contained in the solid lubricant is adsorbed by metal soap M in the form of a flaky cut powder and moves together with metal soap M, and hence, is difficult to form a blocking layer having a dense structure capable of sufficiently blocking toner particle P1. This is probably the reason why particle P3*a* does not improve the blocking effect as expected.

Figure 2:
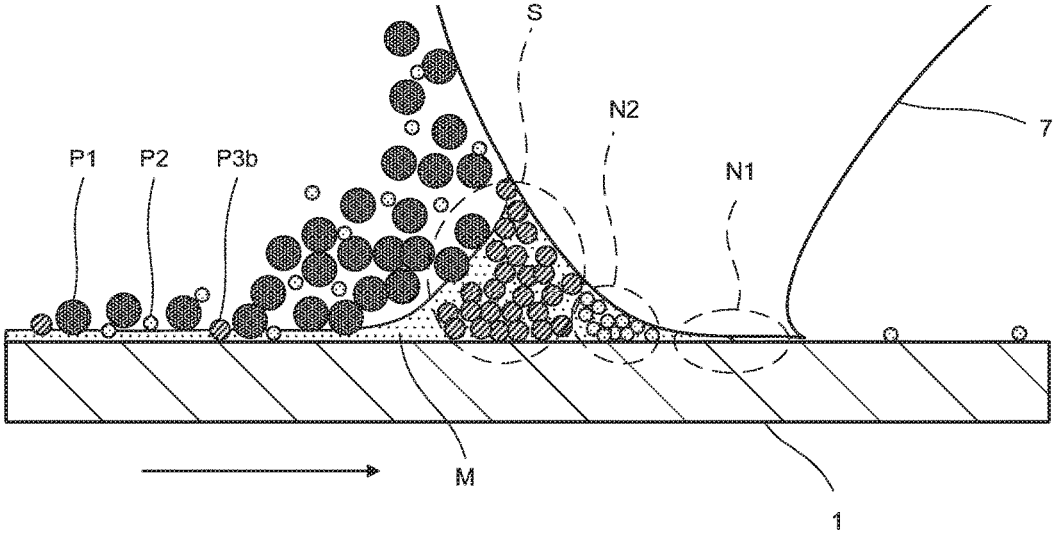
FIG. 2 is a schematic diagram enlargedly illustrating a state in the vicinity of the contact portion between the cleaning blade included in the cleaning device and the surface of the photoconductor when a solid lubricant containing a resin particle according to an embodiment of the present invention is used.

FIG. 2 is a schematic diagram enlargedly illustrating a state in the vicinity of the contact portion between the cleaning blade included in the cleaning device and the surface of the photoconductor when a solid lubricant containing resin particle P3*b* including a particle body containing an amorphous resin as a principal component and a fluorine atom supported on the surface of the particle body is used.

Since resin particle P3*b* supports a fluorine atom on the surface thereof, the surface energy is lower. Therefore, resin particle P3*b* is difficult to be adsorbed by metal soap M in the shape of a flaky cut powder, and moves independently of metal soap M, and therefore, probably can form blocking layer S having a dense structure on the upstream side from the blocking layer formed in collection section N2 so as to effectively block toner particle P1.

Incidentally, also an inorganic fine particle is probably difficult to be adsorbed by metal soap M similarly as long as a fluorine atom is supported thereon. An inorganic fine particle has, however, higher specific gravity, and hence may be circulated by convection in the blocking layer to peel and remove the metal soap provided on the surface of the photoconductor, and may lower the releasability of the toner particle in some cases. By contrast, resin particle P3*b* is an organic fine particle having lower specific gravity, and hence is probably difficult to peel and remove the metal soap provided on the surface of the photoconductor even when circulated by convection in the blocking layer.

Besides, also a particle obtained by micronizing a fluororesin described in Japanese Patent Application Laid-Open No. 2011-059315 is probably similarly difficult to be adsorbed by metal soap M. A particle of a crystalline resin such as a fluororesin is, however, easily cleaved or broken, and hence the specific surface area of the particle is easily increased. The particle thus increased in the specific surface area is easily adsorbed by metal soap M, and therefore, a particle obtained by micronizing a fluororesin is probably difficult to form a blocking layer having a dense structure. By contrast, since resin particle P3*b* includes the particle body containing an amorphous resin as a principal component, it is more difficult to be cleaved or broken than a crystalline resin particle, and therefore, blocking layer S having a dense structure is probably easily formed.

Also in FIG. 2, part of an external additive and the resin particle included in the blocking layer may pass through a gap between cleaning blade 7 and the surface of photoconductor 1 and slip through cleaning nip section N1 to flow out to the downstream side. In this case, resin particle P3*b* has lower surface energy because a fluorine atom is supported on the surface thereof and is an organic fine particle having proper elasticity, and therefore can slip through the gap between cleaning blade 7 and the surface of photoconductor 1 with lower resistance. Accordingly, resin particle P3*b* can probably reduce vibration (slip-stick motion) of cleaning blade 7 caused in the slipping, so as to inhibit occurrence of a cleaning failure derived from the vibration.

1-1-1. Shape and Physical Properties of Resin Particle

From the viewpoints of reducing the specific surface area to reduce the contact area between the resin particle and the metal soap and inhibiting the adsorption of the resin particle to the metal soap in the shape of a flaky cut powder, the resin particle has a volume average particle size (hereinafter, the volume average particle size means an average of primary volume particle sizes of resin particles) of 70 nm or more.

From these points of view, the volume average particle size of the resin particle is more preferably 120 nm or more.

On the other hand, it is preferable that the resin particle is not appropriately too large from the viewpoint that a large gap is difficult to be formed between the resin particle and the surface of the photoconductor and between the cleaning blade pressed by the resin particle and the surface of the photoconductor, so as to further improve the cleaning property by inhibiting a toner particle, an external additive, the resin particle and the like from flowing through the gap. From this point of view, the volume average particle size of the resin particle is preferably 1,000 nm or less, more preferably 900 nm or less, and further preferably 750 nm or less.

The volume average particle size of the resin particle can be obtained, for example, using a laser diffraction/scattering particle size distribution measuring apparatus ("LA-960" (manufactured by Horiba Ltd.)).

The resin particle may be formed from the particle body alone, or may be a particle having a core-shell structure using the particle body as a core. When the resin particle is a particle having a core-shell structure, a resin used for forming a shell portion may be the same as or different from a resin forming the particle body (the core portion). Alternatively, the resin forming the shell portion may be a resin containing fluorine such as a fluororesin as described later.

The resin particle preferably has hardness sufficient for keeping the particle shape in the cleaning nip section. From this point of view, the resin particle preferably has Rockwell hardness M scale. Besides, from this point of view, the resin particle preferably has a degree of vacuum of 1.3 or less. When the resin particle is a particle having a core-shell structure, the core portion corresponding to the particle body preferably has the aforementioned hardness or degree of vacuum.

The resin particle has such a small particle size that it is difficult to measure the hardness of itself, but the hardness can be relatively checked, for example, by measuring the Rockwell hardness using a member having the same composition as the resin particle. Alternatively, the particle shape of the resin particle under condition of nip pressure applied in the cleaning nip section is observed, and it can be checked that the resin particle has desired hardness by observing that the particle shape (or the core portion of the resin particle having a core-shell structure) is not substantially deformed.

Besides, the degree of vacuum of the resin particle can be measured using, for example, a measuring device such as AccuPyc 1330 manufactured by Shimadzu Corporation by a gas replacement measuring method using helium. In this case, a measurement sample precisely weighed is put in a stainless steel cell having an inner diameter of 18.5 mm, a length of 39.5 mm and a volume of 10 $cm^3$, a volume of a fine powder held in the sample cell (the measurement sample of the resin particle) is measured with a helium pressure changed, and the degree of vacuum of the resin particle can be obtained based on the thus obtained volume and the weight of the sample.

1-1-2. Particle Body

The particle body is not limited as long as it contains an amorphous resin as a principal component. Incidentally, that the particle body contains a given resin as a principal component means that the resin occupies the largest mass among one or plural resins contained in the particle body. The particle body may contain merely one resin, or may contain two or more different resins. The particle resin may contain a crystalline resin in a smaller amount than the amorphous resin as long as the crystalline resin does not make the resin body remarkably easily cleaved or broken.

The type of the amorphous resin is not especially limited, and acrylic resins, styrene resins, styrene-acrylic resins and the like are preferred from the viewpoint that a particle having a uniform particle size can be easily produced and that such resins are suitable for micronization.

Examples of the acrylic resins include homopolymers and copolymers of acrylic-based monomers including acrylic acid derivatives and the like such as acrylic acids and esters thereof, methacrylic acids and esters thereof, acrylamide, methacrylamide, acrylonitrile, and methacrylonitrile.

Examples of the styrene resins include homopolymers of styrene-based monomers including styrene, styrene derivatives and the like, and copolymers each containing a styrene-based monomer as a principal component and obtained through copolymerization with a vinyl compound copolymerizable with the monomer. Examples of the styrene-based monomers include aromatic vinyl compounds including styrene, α-methylstyrene, p-chlorostyrene, p-methylstyrene, vinyl naphthalene and the like.

Examples of the styrene-acrylic resins include copolymers of the styrene-based monomers and the acrylic-based monomers described above.

A weight average molecular weight (Mw) of the amorphous resin is, in terms of a value measured by gel permeation chromatography (GPC) against a polystyrene standard, preferably 5,000 or more from the viewpoint of controllability of the volume average particle size. Besides, the Mw is preferably 500,000 or less from the viewpoint of controllability and availability of the volume average particle size.

1-1-3. Fluorine Atom

The fluorine atom is supported on the surface of the particle body. The fluorine atom is not limited as long as it is present at least in the vicinity of the surface of the particle body and moves together with the particle body in association with the movement of the resin particle, and may be chemically bonded to the surface of the particle body or may be physically supported on the surface of the particle body through interaction using intermolecular forces or the like.

When the resin particle is a particle having a core-shell structure, the fluorine atom may be chemically bonded to the surface of the shell portion, or may be physically supported on the surface of the shell portion through the interaction using intermolecular forces or the like.

When the fluorine atom is chemically bonded to the particle body or the shell portion, the fluorine atom may be included in a structural unit of a resin forming the surface of the particle body or the shell portion, or may be appropriately bonded to a resin forming the surface of the particle body or the shell portion via a specific functional group. For example, the fluorine atom may be derived from a fluororesin contained in the shell portion of the resin particle, which includes the core portion (the particle body) containing an amorphous resin as a principal component and the shell portion containing a fluororesin.

The fluorine atom is not limited as long as it is present on the surface of the resin particle, and may be present in an inner portion of the resin particle unless the resin particle can be remarkably easily cleaved or broken.

From the viewpoint that the surface energy of the resin particle is reduced to make the resin particle difficult to be adsorbed by metal soap M in the shape of a flaky cut powder, it is preferable that the fluorine atom has an appropriately high abundance (content) on the surface of the resin particle.

From this point of view, the fluorine atom has an abundance of preferably 5 atom % or more, and more preferably 10 atom % or more.

On the other hand, from the viewpoint that the characteristic of the amorphous resin to make the particle body difficult to be cleaved and broken is retained to make the resin particle difficult to be cleaved and broken, it is preferable that the fluorine atom does not have an excessive abundance (content) on the surface of the resin particle. From this point of view, the fluorine atom has an abundance on the surface of the resin particle of preferably 60 atom % or less, and more preferably 50 atom % or less.

The abundance of the fluorine atom on the surface of the resin particle can be obtained by X-ray photoelectron spectroscopy (XPS). Specifically, the abundance of the fluorine atom on the surface of the resin particle can be obtained as a ratio of a measured value of a fluorine element obtained through quantitative analysis of elements presumed to be present on the surface of the particle, or as a calculated value of a concentration of the target fluorine element on the surface of the resin particle calculated using a relative sensitivity factor based on respective atom peak areas. Elements presumed to be present on the surface of the particle may be all elements actually present on the surface of the resin particle, or may be merely representative elements including fluorine. For example, the presumed elements may be elements, excluding hydrogen, forming the resin such as carbon and oxygen.

When the resin particle is a particle having the core-shell structure, the resin forming the shell portion may be a fluororesin, or may be a resin retaining a fluorine-containing compound and different from a fluororesin.

Examples of the fluororesin include polytetrafluoroethylene (PTFE), a perfluoroalkylvinylether/tetrafluoroethylene copolymer (PFA), a hexafluoropropylene/tetrafluoroethylene copolymer (FEP), an ethylene/tetrafluoroethylene copolymer (ETFE), a copolymer of tetrafluoroethylene and a heterocycle-containing fluorine-based monomer, polychlorotrifluoroethylene (PCTFE), a fluoroalkyl (meth)acrylate polymer, a copolymer of fluoroalkyl (meth)acrylate and another alkyl (meth)acrylate, polyvinylidene fluoride (PVDF), a tetrafluoroethylene/vinylidene fluoride copolymer, and a perfluoroalkylvinylether/vinylidene fluoride copolymer.

An example of the resin retaining a fluorine-containing compound and different from a fluororesin includes a dried or solidified product of a resin emulsion containing a fluorine-based surfactant, and more specifically, a resin included in a resin layer formed by coating the resin emulsion on a surface of a core particle.

The resin particle having the core-shell structure may be a synthetic product or a commercially available product. A method for polymerizing the resin particle is not especially limited, and the resin particle can be produced by any of conventionally known production methods such as suspension polymerization, dispersion polymerization and seed polymerization.

1-2. Metal Soap

The metal soap can be appropriately selected from metal soaps known to be used in a solid lubricant to be coated on a photoconductor in an electrophotographic image forming apparatus. One metal soap, or two or more metal soaps may be used. Examples of the metal soap include fatty acid metal salts in which a metal such as calcium, magnesium, aluminum, lead, zinc, copper or iron is bonded to a straight chain hydrocarbon such as myristic acid, palmitic acid, stearic acid or oleic acid. From the viewpoint of further improving the releasability of a toner particle, the metal soap is preferably zinc stearate or aluminum stearate.

1-3. Components in Solid Lubricant

A rate of introducing the resin particle into the solid lubricant (a content of the resin particle with respect to the total mass of the solid lubricant) is preferably appropriately high from the viewpoint of forming a blocking layer capable of sufficiently blocking a toner particle. From this point of view, the rate of introducing the resin particle into the solid lubricant is preferably 3 vol % or more, and more preferably 5 vol % or more.

On the other hand, it is preferable that the rate of introducing the resin particle into the solid lubricant is not excessive from the viewpoint that an effect of releasing a toner particle by the metal soap is not remarkably inhibited. From this point of view, the rate of introducing the resin particle into the solid lubricant is preferably 50 vol % or less, and more preferably 40 vol % or less.

A content of the metal soap with respect to the total mass of the solid lubricant is preferably 50 vol % or more, more preferably 70 vol % or more, and further preferably 80 vol % or more.

As long as the effects of the present embodiment can be obtained, the solid lubricant may further contain another component in addition to the metal soap and the rein particle.

The solid lubricant can be produced by a known method. For example, the solid lubricant can be produced by mixing the metal soap and the resin particle, melting the resultant by heating, pouring the resultant into a mold, and subsequently solidifying the resultant by cooling. Alternatively, the solid lubricant can be produced by mixing the metal soap and the resin particle, and compression molding the resultant.

The solid lubricant is coated on a photoconductor in an electrophotographic image forming apparatus. The lubricant can be supplied to the photoconductor by a known method. For example, when mixed with a toner as an external additive, the solid lubricant is supplied to the surface of the photoconductor when the toner is subjected to development, and can be coated on the surface of the photoconductor when leveled by a cleaning member thereafter. From the viewpoint that the solid lubricant is sufficiently and stably supplied to the whole surface of the photoconductor regardless of an image portion and a non-image portion on the surface of the photoconductor, the solid lubricant is coated on the surface of the photoconductor preferably using a solid lubricant coater for coating the solid lubricant.

2. Image Forming Apparatus and Solid Lubricant Coater

Another embodiment of the present invention relates to an image forming apparatus and a solid lubricant coater using the above-described solid lubricant.

The image forming apparatus of the present embodiment can be configured in the same manner as a known electrophotographic image forming apparatus including a photoconductor, a cleaning device and a solid lubricant coater except for the solid lubricant coater. The solid lubricant coater of the present embodiment can be configured in the same manner as a known solid lubricant coater except that the solid lubricant according to the above-described embodiment is used.

Figure 3:
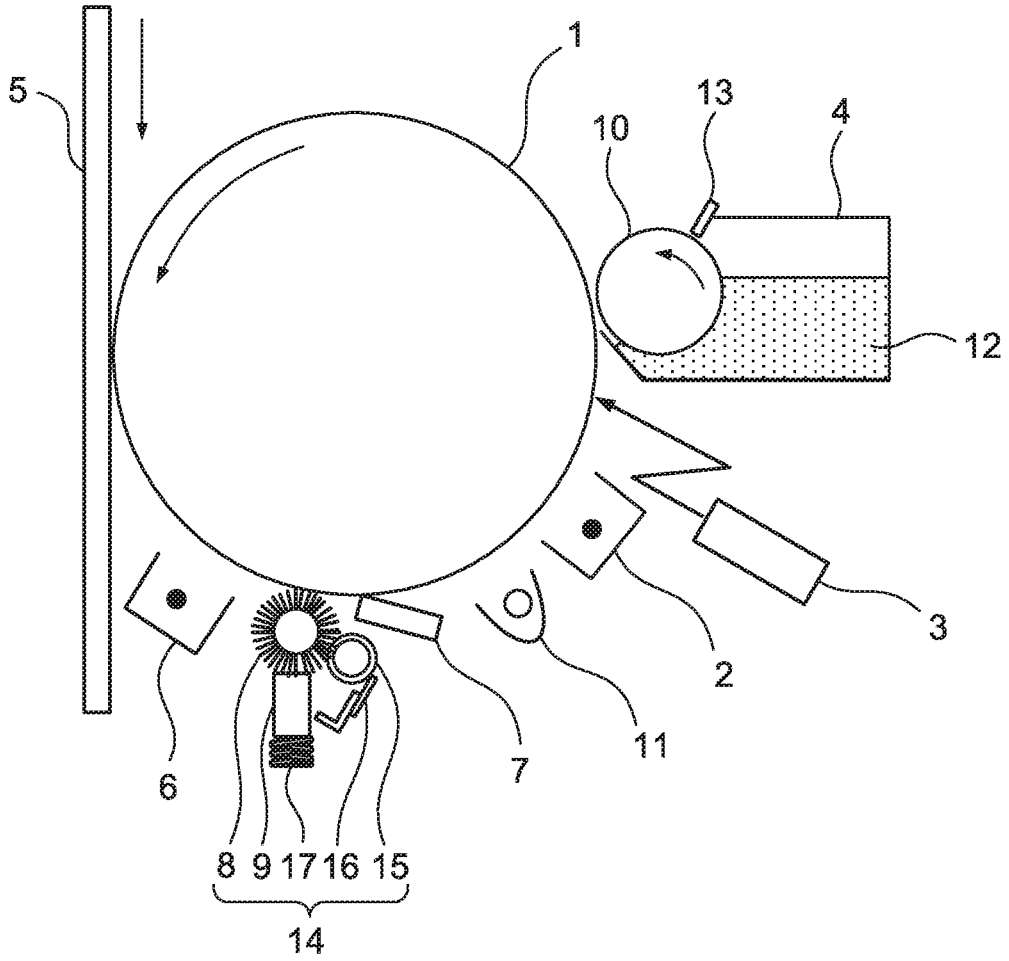
FIG. 3 is a schematic diagram illustrating a part of the structure of an image forming apparatus according to an embodiment of the present invention.

FIG. 3 is a schematic diagram illustrating part of the structure of the image forming apparatus of the present embodiment. The image forming apparatus of the present embodiment includes, as illustrated in FIG. 3, photoconductor 1, charging device 2, exposing device 3, developing device 4, intermediate transfer member 5, charging device 6, solid lubricant coater 14, a cleaning device and pre-exposing device 11.

Photoconductor 1 corresponds to the above-described image bearing member, and is, for example, a known organic photoconductor. Photoconductor 1 has an aluminum drum-shaped conductive base (conductive support) and a photosensitive layer disposed on the outer peripheral surface of the base. The photosensitive layer is, for example, a resin layer having a thickness of 25 μm containing a polycarbonate resin and a photosensitive material such as a charge generating compound or a charge transporting compound. Photoconductor 1 is rotatably disposed, and a rotational speed thereof is, for example, 460 mm/sec.

Charging device 2 is a noncontact charging device employing corona discharging. Exposing device 3 includes, for example, a device for irradiating a laser beam and an optical system not shown for forming an optical path of the laser beam.

Developing device 4 includes developing sleeve 10 disposed to oppose photoconductor 1, and developing blade 13 restricting a thickness of a toner to be supported on a surface of developing sleeve 10, and holds two-component developer 12 therein. A toner particle included in two-component developer 12 includes a toner base particle produced by emulsion polymerization and having a volume average particle size of 6.5 μm, and contains, as an external additive, an inorganic fine particle such as silica or titania externally added to the toner base particle. Besides, the toner particle is negatively chargeable.

Intermediate transfer member 5 is an endless belt made of a polyimide resin provided with conductivity. The belt is pressed against photoconductor 1 by a transfer roller not shown at the time of transferring a toner image. Charging device 6 is disposed on the downstream side from the transfer roller in a rotational direction of photoconductor 1, and is, for example, a noncontact charging device employing the corona discharging.

Solid lubricant coater 14 is disposed on the downstream side from charging device 6 in the rotational direction of photoconductor 1. Solid lubricant coater 14 includes rotary brush 8, solid lubricant 9, flicker 15 and scraper 16.

Rotary brush 8 is a conductive fur brush made of conductive polyester fiber standing on a surface of a rotation axis. A brush bristle of rotary brush 8 has a length of 3 mm and a thickness of 3 d (denier), and a density of the brush bristles is 180 (kF/inch$^2$). Besides, a roller diameter is 14 mm. Rotary brush 8 is disposed in a position where a tip of the brush bristle bites into the surface of photoconductor 1 by, for example, 0.8 mm, and rotates at a relative speed θ:1.3 to photoconductor 1 in the forward direction.

Solid lubricant 9 is the solid lubricant according to the above-described embodiment. Solid lubricant 9 has an elongated rectangular parallelepiped shape having a length equivalent to a drum length of photoconductor 1 (a length of a brush portion in the axial direction of rotary brush 8), and having a rectangular cross section along the lengthwise direction, and is pressed toward rotary brush 8 by spring 17 corresponding to an abutment member (with, for example, a spring pressure of 0.7 N/m) to be brought into contact with rotary brush 8.

Flicker 15 is in contact with rotary brush 8 while biting thereinto by, for example, 1 mm in a position between photoconductor 1 and solid lubricant 9 on the upstream side in the rotational direction of rotary brush 8. Flicker 15 is, for example, a metal pipe. Scraper 16 is in contact with the surface of flicker 15. Scraper 16 removes deposits (such as solid lubricant 9) on the surface of flicker 15 off from the surface.

The cleaning device includes a cleaning vessel not shown, and cleaning blade 7 supported in an opening of the vessel. Solid lubricant coater 14 is disposed inside the opening of the cleaning vessel, and cleaning blade 7 is disposed in a position on the downstream side from solid lubricant coater 14 in the rotational direction of photoconductor 1.

Cleaning blade 7 is an elastic plate, and for example, is a urethane rubber plate having a modulus of resilience of 24% (25° C.), JIS A hardness of 72°, a thickness of 2.00 mm, a free length of 10 mm and a width of 324 mm. Cleaning blade 7 is in contact, at one edge thereof, with the whole length of photoconductor 1 in the lengthwise direction. Contact load of cleaning blade 7 against photoconductor 1 is 25 N/m, and a contact angle therebetween is 18°. Pre-exposing device 11 is a light irradiating device, and is disposed between cleaning blade 7 and charging device 2.

Charging device 2 applies a voltage to the surface of photoconductor 1 rotating. The surface of photoconductor 1 thus charged is irradiated with a laser beam by exposing device 3, and thus, an electrostatic latent image corresponding to an image to be formed is formed on the surface of photoconductor 1.

Developing sleeve 10 is rotatively driven at a linear speed of 800 mm/min, and a bias voltage of the same polarity as a surface potential of photoconductor 1 is applied thereto. In developing device 4, two-component developer 12 is negatively charged while being stirred and conveyed toward developing sleeve 10. Developing device 4 performs reversal development using two-component developer 12 by applying the bias voltage to developing sleeve 10. A toner particle contained in two-component developer 12 adheres to the electrostatic latent image, and thus, the electrostatic latent image is developed.

Intermediate transfer member 5 is pressed against the surface of photoconductor 1 thus bearing a toner image, and a voltage usually of reverse polarity to the charge polarity of the toner is applied thereto by the transfer roller. In this manner, the toner image born on the surface of photoconductor 1 is transferred to a surface of intermediate transfer member 5. The thus transferred toner image is further transferred to a recording medium such as plain paper, fixed thereon through heat pressing by a fixing device, and thus, a desired image is formed on the recording medium.

Charging device 6 applies a voltage to the surface of photoconductor 1 after transferring the toner image. Through this voltage application, the deposits such as an untransferred toner adhering to the surface of photoconductor 1 after the transfer are uniformly adjusted in polarity.

On the other hand, solid lubricant 9 pressed by spring 17 and in contact with rotary brush 8 adheres to rotary brush 8. The solid lubricant thus adhering is supplied to the charged surface of photoconductor 1, and thus, the solid lubricant is coated on the surface of photoconductor 1. Incidentally, deposits on rotary brush 8 are transferred to flicker 15, scraped off from the surface of flicker 15 by scraper 16, and collected in the cleaning vessel.

Cleaning blade 7 comes into contact with the surface of photoconductor 1 on which the solid lubricant has been coated. The untransferred toner is removed from the surface of photoconductor 1 by cleaning blade 7, and the solid lubricant is partially scraped off by cleaning blade 7 to be leveled in a prescribed thickness. The untransferred toner and the solid lubricant scraped by cleaning blade 7 are collected in the cleaning vessel.

Pre-exposing device 11 irradiates the surface of photoconductor 1 from which the untransferred toner has been removed with light for uniformly adjusting the surface potential of photoconductor 1. In this manner, the electrostatic history of photoconductor 1 is erased from the surface of photoconductor 1 before starting a charging process for forming a next electrostatic latent image.

EXAMPLES

Now, the present invention will be described with reference to specific Examples and Comparative Examples, and it is noted that the present invention is not limited to these Examples.

Incidentally, a volume average particle size D of each resin particle described below is, with respect to a commercially available product, a value announced by a manufacturer, and with respect to a synthetic product, a volume average particle size obtained using a laser diffraction/scattering particle size distribution measuring apparatus ("LA-960" (manufactured by Horiba Ltd.)).

Besides, a fluorine atom abundance CF in each resin particle described below is an amount of fluorine measured through quantitative analysis of selected elements of fluorine, carbon and oxygen using an X-ray photoelectron spectrometer "K-Alpha" (manufactured by Thermo Fisher Scientific K.K.).

(Measurement Conditions)

X-rays: Al monochromatic source

Acceleration: 12 kV, 6 mA

Resolution: 50 eV

Beam diameter: 400 μm

Step size: 0.1 eV

1. Solid Lubricant 1-1. Resin Particle 1-1-1. Resin Particle F1

A 5,000 ml separable flask equipped with a stirrer, a temperature sensor, a condenser and a nitrogen introducing device was charged with a surfactant solution containing an anionic surfactant represented by the following formula (1) dissolved in ion-exchanged water, followed by increasing the temperature within the flask up to 80° C. with stirring under nitrogen stream.

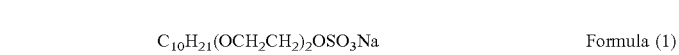

$$C_{10}H_{21}(OCH_2CH_2)_2OSO_3Na \qquad \text{Formula (1)}$$

(First Stage Polymerization)

To the surfactant solution, an initiator solution containing potassium persulfate corresponding to a polymerization initiator dissolved in ion-exchanged water was added. Thereafter, to the surfactant solution heated to 75° C., monomer mixture 1 obtained by mixing styrene, n-butyl acrylate and methacrylic acid was added in a dropwise manner over 1 hour. After completing the dropwise addition, the resultant was heated and stirred for 2 hours with the temperature of the system kept at 75° C. to obtain latex 1.

(Second Stage Polymerization)

To latex 1, an initiator solution containing potassium persulfate corresponding to a polymerization initiator dissolved in ion-exchanged water was added. Thereafter, to the resultant latex heated to 80° C., monomer mixture 2 obtained by mixing styrene, n-butyl acrylate, methacrylic acid, 2,2,2-trifluoroethyl methacrylate and n-octyl-3-mercaptopropionate was added in a dropwise manner over 1 hour. After completing the dropwise addition, the resultant was heated and stirred for 2 hours with the temperature of the system kept at 80° C., and the resultant was then cooled to 28° C. to obtain a dispersion of an amorphous resin particle.

The dispersion was dried to obtain resin particle F1 in which a styrene-acrylic resin was a particle body (core) and a fluorine atom was supported on a surface thereof.

The volume average particle size D of resin particle F1 was 250 nm, and the fluorine atom abundance CF on the surface of resin particle F1 was 32 atom %.

1-1-2. Resin Particle F2

A resin particle having a core-shell structure, which is a product developed by Nipponpaint Industrial Coatings Co., LTD., was used as resin particle F2. Resin particle F2 includes a core portion containing a styrene resin as a principal component and a shell portion of a fluororesin, and has a fluorine atom on the surface of the shell portion.

The volume average particle size D of resin particle F2 was 100 nm, and the fluorine atom abundance CF on the surface of resin particle F2 was 34 atom %.

1-1-3. Resin Particle F3

Resin particle F3 was obtained in the same manner as in the production of resin particle F1 except that the concentration of the anionic surfactant in the surfactant solution used in the first stage polymerization or the second stage polymerization, the amount of monomer mixture 1 or monomer mixture 2, or the concentration of the initiator solution was changed.

The volume average particle size D of resin particle F3 was 70 nm, and the fluorine atom abundance CF on the surface of resin particle F3 was 33 atom %.

1-1-4. Resin Particle F4, Resin Particle F5 and Resin Particle F6

Resin particle F4, resin particle F5 and resin particle F6 respectively having larger volume average particle sizes D were obtained in the same manner as in the production of resin particle F1 except that the first stage polymerization was repeatedly performed.

The volume average particle size D of resin particle F4 was 700 nm, and the fluorine atom abundance CF on the surface of resin particle F4 was 31 atom %.

The volume average particle size D of resin particle F5 was 950 nm, and the fluorine atom abundance CF on the surface of resin particle F5 was 31 atom %.

The volume average particle size D of resin particle F6 was 1,100 nm, and the fluorine atom abundance CF on the surface of resin particle F6 was 32 atom %.

1-1-5. Resin Particle F1*a*, Resin Particle F1*b*, Resin Particle F1*c* and Resin Particle F1*d* Resin particle F1*a*, resin particle F1*b*, resin particle F1*c* and resin particle F1*d* respectively having different fluorine atom abundances CF on the surfaces of the resin particles were obtained in the same manner as in the production of resin particle F1 except that the amount of 2,2,2-trifluoroethyl methacrylate in monomer mixture 2 used in the second stage polymerization was changed.

The volume average particle size D of resin particle F1*a* was 250 nm, and the fluorine atom abundance CF on the surface of resin particle F1*a* was 57 atom %.

The volume average particle size D of resin particle F1*b* was 250 nm, and the fluorine atom abundance CF on the surface of resin particle F1*b* was 7 atom %.

The volume average particle size D of resin particle F1*c* was 250 nm, and the fluorine atom abundance CF on the surface of resin particle F1*c* was 65 atom %.

The volume average particle size D of resin particle F1*d* was 250 nm, and the fluorine atom abundance CF on the surface of resin particle F1*d* was 4 atom %.

1-1-6. Resin Particle B1

Resin particle B1 was obtained in the same manner as in the production of resin particle F1 except that the second stage polymerization was not performed.

The volume average particle size D of resin particle B1 was 200 nm, and the fluorine atom abundance CF on the surface of resin particle B1 was 0 atom %.

1-1-7. Resin Particle B2

Resin particle B2 is Dyneon TF9201Z manufactured by 3M Japan Limited. Resin particle B2 is a resin particle containing, as a principal component, crystalline polytetrafluoroethylene (PTFE).

The volume average particle size D of resin particle B2 was 200 nm, and the fluorine atom abundance CF on the surface of resin particle B2 was 67 atom %.

1-1-8. Resin Particle B3

A widely used silica resin was surface-treated with a known silane coupling agent of trimethoxy(3,3,3-trifluoropropyl)silane to obtain resin particle B3.

The volume average particle size D of resin particle B3 was 350 nm, and the fluorine atom abundance CF on the surface of resin particle B3 was 50 atom %.

1-1-9. Resin Particle B4

A resin particle having a core-shell structure of a product developed by Nipponpaint Industrial Coatings Co., LTD. was used as resin particle B4. Resin particle B4 has a core portion containing a styrene-acrylic resin as a principal component and a shell portion of a fluororesin, and has a fluorine atom on the surface of the shell portion.

The volume average particle size D of resin particle B4 was 60 nm, and the fluorine atom abundance CF on the surface of resin particle B4 was 32 atom %.

The materials of the above-described resin particles (with respect to a core-shell type resin particle, a resin seed corresponding to a principal component of the core portion) and the volume average particle sizes D and the fluorine atom abundances CF thereof are shown in Table 1.

TABLE 1

| Resin Particle | Material | Volume Average Particle Size D | Fluorine Atom Abundance CF |
|---|---|---|---|
| F1 | Styrene-acrylic | 250 | 32 |
| F2 | Styrene | 100 | 34 |
| F3 | Styrene-acrylic | 70 | 33 |
| F4 | Styrene-acrylic | 700 | 31 |
| F5 | Styrene-acrylic | 950 | 31 |
| F6 | Styrene-acrylic | 1100 | 32 |
| F1a | Styrene-acrylic | 250 | 57 |
| F1b | Styrene-acrylic | 250 | 7 |
| F1c | Styrene-acrylic | 250 | 65 |
| F1d | Styrene-acrylic | 250 | 4 |
| B1 | Styrene-acrylic | 200 | 0 |
| B2 | PTFE | 200 | 67 |
| B3 | Silica | 350 | 50 |
| B4 | Styrene-acrylic | 60 | 32 |

1-2. Metal Soap

The following metal soaps were used:

StZn: zinc stearate (ZnSt-G, manufactured by NOF CORPORATION)

StAl: aluminum stearate (aluminum stearate 900, manufactured by NOF CORPORATION)

1-3. Production of Solid Lubricant 1-3-1. Solid Lubricant 1

A mixture was obtained by mixing, with a Henschel mixer, 85 parts by weight of zinc stearate and 15 parts by weight of resin particle F1. The mixing was performed under conditions of a peripheral speed of an impeller of 35 m/sec., a treatment temperature (a temperature in a tank) of 32° C. and a mixing time of 3 minutes.

The mixture was poured into a mold having an internal temperature of 160° C. with controlling the temperature not to be lowered below 150° C., and the resultant mold was allowed to stand still with the internal temperature kept at 150° C. Thereafter, the mold was cooled to room temperature (25° C.) at a cooling rate of 1° C./min under control for avoiding temperature irregularities, and a solid substance resulting from the cooling was taken out of the mold. Thus, solid lubricant 1 having a depth of 8 mm, a width of 5 mm and a length of 328 mm was obtained.

Solid lubricants 2 to 19 were obtained in the same manner as in the production of solid lubricant 1 except that the type of and the rate of introducing the resin particle, and the type of the metal soap were changed as shown in Table 2.

TABLE 2

| Solid Lubricant | Resin Particle | Rate of Introduction (vol %) | Metal Soap |
|---|---|---|---|
| 1 | F1 | 15 | StZn |
| 2 | F4 | 15 | StZn |
| 3 | F2 | 15 | StZn |
| 4 | F1 | 15 | StAl |
| 5 | F1a | 15 | StZn |
| 6 | F1 | 48 | StZn |
| 7 | F1 | 4 | StZn |
| 8 | F1b | 15 | StZn |
| 9 | F5 | 15 | StZn |
| 10 | F3 | 15 | StZn |
| 11 | F1c | 15 | StZn |
| 12 | F1 | 53 | StZn |
| 13 | F1 | 2 | StZn |
| 14 | F1d | 15 | StZn |
| 15 | F6 | 15 | StZn |
| 16 | B1 | 15 | StZn |
| 17 | B2 | 15 | StZn |
| 18 | B3 | 15 | StZn |
| 19 | B4 | 15 | StZn |

2. Evaluation 2-1. Image Forming Apparatus

As an electrophotographic image forming apparatus, an experimental apparatus based on a digital printing system "bizhub PRESS C1100" manufactured by Konica Minolta, Inc. was prepared. The experimental apparatus had the structure as illustrated in FIG. 3. Incidentally, in order to evaluate each solid lubricant in a condition where toner slipping can be easily caused, a cleaning blade included in a drum unit was precedently polished with sandpaper having granularity of 0.3 to 3 μm to abrade a blade edge portion thereof in a width of 50 μm. Besides, in order to evaluate each solid lubricant in the condition where the toner slipping can be easily caused, the temperature was adjusted to 10° C. and the humidity was adjusted to 20% RH in printing.

One of solid lubricants 1 to 19 was mounted on the drum unit of the experimental apparatus. First, 100 copies of an image chart having a coverage rate of 10% and including one line image formed along the whole width of recording medium A (J paper in A3 size, manufactured by Konica Minolta Business Solutions, Inc.) in a direction crossing a conveyance direction of the recording medium were continuously printed on both surfaces of each recording medium. The image chart included one belt with a width of 44 mm extending in a direction vertical to the conveyance direction. In this manner, a state where the solid lubricant had been coated on the surface of the photoconductor and a fine particle contained in the solid lubricant had been supplied to the cleaning nip section was obtained.

2-2. Removal of Toner

Next, a current to be applied in a primary transfer step of the experimental apparatus was set to a current value lower than that used under standard conditions, and thus, a toner was made difficult to be transferred to a transfer belt, and a state where an untransferred toner through the primary transfer in a larger amount than usual was to rush into the cleaning blade was obtained. Specifically, the experimental apparatus was set so that when the toner adhering in an amount of 4 $g/m^2$ per unit area was developed on the photoconductor, 0.5 $g/m^2$ of the toner could rush into the cleaning blade as the untransferred toner. Under this condition, 50 copies of an entire solid image with a toner adhering amount of 4 $g/m^2$ were continuously printed. After the printing, the drum unit of the experimental apparatus was taken out, the surface of the photoconductor and the surface of recording medium A were visually observed, and it was checked whether or not a state where the toner was present as a streak on the surface of the photoconductor or a non-image portion of recording medium A (toner slipping) was observed. When the toner slipping was not observed, the solid lubricant was evaluated as "cleanable", and when observed, the solid lubricant was evaluated as "uncleanable".

Printing processes for printing 100 copies of the 10% image chart and 50 copies of the solid image were repeatedly performed with a pressing spring of the cleaning blade for pressing a plate member toward the surface of the photoconductor changed with another spring different in spring constant (in a pressing force toward the plate member). In this manner, with respect to each solid lubricant used in the experiment, a minimum pressing force with which the solid lubricant could be evaluated as "cleanable" was obtained.

The minimum pressing force with which the solid lubricant was evaluated as "cleanable" was used to obtain, in accordance with the following expression, a pressure reduction rate Rd to be used as an index for cleaning performance. A standard pressing force was set to 28 N/m. As the pressing force is smaller, the toner slipping is easily caused, and as the minimum pressing force of a solid lubricant is smaller, the cleaning property thereof is better. A solid lubricant whose pressure reduction rate exceeded 100% (a solid lubricant with which the slipping was caused under standard load) was evaluated as unacceptable.

(Expression)

$$\text{Pressure reduction rate Rd (\%)}=\{(\text{minimum pressing force})/(\text{standard pressing force})\}\times 100$$

The pressure reduction rates Rd of the respective solid lubricants are shown in Table 3.

TABLE 3

| Solid Lubricant | Pressure Reduction Rate Rd (%) |
|---|---|
| 1 | 58 |
| 2 | 58 |
| 3 | 61 |
| 4 | 58 |
| 5 | 65 |
| 6 | 67 |
| 7 | 69 |
| 8 | 71 |
| 9 | 73 |
| 10 | 77 |
| 11 | 80 |
| 12 | 84 |
| 13 | 90 |
| 14 | 95 |
| 15 | 100 |

TABLE 3-continued

| Solid Lubricant | Pressure Reduction Rate Rd (%) |
|---|---|
| 16 | 120 |
| 17 | 105 |
| 18 | 110 |
| 19 | 105 |

As is obvious from the results shown in Table 3, in using solid lubricants 1 to 15 each of which contains the resin particle including the particle body containing the amorphous resin as a principal component and a fluorine atom supported on the surface of the particle body, and having a volume average particle size of 70 nm or more, and the metal soap, the slipping of a toner particle was inhibited even when the pressing force of the pressing spring of the cleaning blade was set to be smaller. This is probably because a blocking layer of the resin particle capable of inhibiting the slipping by sufficiently blocking the toner particle could be formed.

In particular, the toner slipping was more effectively inhibited in using solid lubricants 1 to 14 each of which contains the resin particle having a volume average particle size of 1,000 nm or less. This is probably because a large gap was difficult to be formed between the resin particle and the surface of the photoconductor and between the cleaning blade pressed by the resin particle and the surface of the photoconductor, and hence the slipping of the toner particle through such a gap was inhibited.

Besides, the toner slipping was more effectively inhibited in using solid lubricants 1 to 13 each of which contains the resin particle having the fluorine atom abundance on the surface of 5 atom % or more. This is probably because the surface energy of the resin particle was reduced so that the resin particle was difficult to be adsorbed by the metal soap in the shape of a flaky cut powder.

Furthermore, the toner slipping was more effectively inhibited in using solid lubricants 1 to 12 each of which contains the resin particle in an amount corresponding to the rate of introduction into the solid lubricant of 3 vol % or more. This is probably because a blocking layer capable of sufficiently blocking the toner particle could be formed.

Besides, the toner slipping was more effectively inhibited in using solid lubricants 1 to 11 each of which contains the resin particle in an amount corresponding to the rate of introduction into the solid lubricant of 50 vol % of less. This is probably because the resin particle did not remarkably interfere the effect of releasing the toner particle owing to the metal soap.

Besides, the toner slipping was more effectively inhibited in using solid lubricants 1 to 10 each of which contains the resin particle having the fluorine atom abundance on the surface thereof of 60 atom % or less. This is probably because the rein particle was difficult to be cleaved or broken.

On the other hand, in using solid lubricant 16 containing the resin particle in which a fluorine atom was not supported on the surface, the toner slipping was not inhibited. This is probably because the resin particle was adsorbed by the metal soap and moved together with the metal soap, and hence, a blocking layer capable of sufficiently blocking the toner particle was difficult to be formed.

Besides, in using solid lubricant 17 containing the resin particle including a particle body containing a crystalline resin as a principal component, the toner slipping was not inhibited. This is probably because the resin particle was easily cleaved or broken, and hence the specific surface area of the resin particle was increased and the resin particle was easily adsorbed by the metal soap, and as a result, a blocking layer having a dense structure was difficult to be formed.

Furthermore, in using solid lubricant 18 containing the resin particle including a particle body containing an inorganic fine particle as a principal component, the toner slipping was not inhibited. This is probably because the inorganic fine particle had high specific gravity, and hence was circulated by convection in a blocking layer to peel and remove the metal soap provided on the surface of the photoconductor, and as a result, the releasability of the toner particle was lowered.

Furthermore, in using solid lubricant 19 containing the resin particle having an average particle size less than 70 nm, the toner slipping was not inhibited. This is probably because the resin particle had such a large specific surface area that the resin particle was easily adsorbed by the metal soap, and hence a blocking layer having a dense structure was difficult to be formed.

According to the present invention, the cleaning effect in an image forming apparatus can be sufficiently increased by using a specific solid lubricant. Therefore, according to the present invention, an electrophotographic system for forming a high quality image is expected to be further developed.

Although embodiments of the present invention have been described and illustrated in detail, it is clearly understood that the same is by way of illustration and example only and not limitation, the scope of the present invention should be interpreted by terms of the appended claims.

What is claimed is:

1. A solid lubricant to be coated on an image bearing member included in an electrophotographic image forming apparatus, comprising:

resin particles and metal soap, wherein the resin particles are contained within the metal soap, each of the resin particles includes a particle body containing an amorphous resin as a principal component, and a compound containing a fluorine atom supported on a surface of the particle body, and the resin particles have a volume average particle size of 70 nm or more.

2. The solid lubricant according to claim 1, wherein the resin particles have a volume average particle size of 1,000 nm or less.

3. The solid lubricant according to claim 1, wherein each of the resin particles has a fluorine atom abundance on a surface thereof of 5 atom % or more.

4. The solid lubricant according to claim 1, wherein the resin particles are contained in an amount corresponding to a rate of introducing the resin particles into the solid lubricant of 3 vol % or more.

5. The solid lubricant according to claim 1, wherein the resin particles are contained in an amount corresponding to a rate of introducing the resin particles into the solid lubricant of 50 vol % or less.

6. The solid lubricant according to claim 1, wherein each of the resin particles has a fluorine atom abundance on a surface thereof of 60 atom % or less.

7. A solid lubricant coater for coating a solid lubricant on a surface of an image bearing member included in an electrophotographic image forming apparatus, comprising:

a coating member that coats the solid lubricant according to claim 1 on the surface of the image bearing member; and an abutment member that brings the solid lubricant into contact with the coating member by pressing.

8. An electrophotographic image forming apparatus, comprising:

an image bearing member;

a cleaner that removes an untransferred toner from a surface of the image bearing member by bringing an elastic member into contact with the surface; and the solid lubricant coater according to claim 7 that coats the solid lubricant on the surface of the image bearing member.

9. The solid lubricant according to claim 1, wherein the amorphous resin is selected from the group consisting of an acrylic resin, a styrene resin, and a styrene-acrylic resin.

10. The solid lubricant according to claim 1, wherein the compound containing the fluorine atom is a fluororesin or a fluorine-containing surfactant.

* * * * *